US008061702B2

(12) United States Patent
Caunter

(10) Patent No.: US 8,061,702 B2
(45) Date of Patent: Nov. 22, 2011

(54) SIGNATURE TRANSPORT DEVICE

(75) Inventor: Nicholas J. Caunter, Portsmouth, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 12/802,460

(22) Filed: Jun. 8, 2010

(65) Prior Publication Data

US 2010/0252400 A1 Oct. 7, 2010

Related U.S. Application Data

(63) Continuation of application No. 10/771,994, filed on Feb. 4, 2004, now Pat. No. 7,748,517.

(51) Int. Cl.
*B65H 29/00* (2006.01)

(52) U.S. Cl. ..... 270/52.26; 270/52.29; 198/468.2; 198/469.1; 198/470.1

(58) Field of Classification Search ..... 198/470.1, 198/472.1, 469.1, 644; 270/52.26, 52.29; 271/3.24, 82, 85, 204, 206
See application file for complete search history.

(56) References Cited

U.S. PATENT DOCUMENTS

| | | | | |
|---|---|---|---|---|
| 3,768,406 | A | 10/1973 | Gutsche et al. | 101/404 |
| 4,471,955 | A | 9/1984 | Bradley et al. | 270/58 |
| 4,697,246 | A | 9/1987 | Zemke et al. | 702/128 |
| 4,728,097 | A | 3/1988 | Vandersyde et al. | 271/268 |
| 4,852,722 | A | 8/1989 | Houseman | 198/803.7 |
| 5,244,078 | A | 9/1993 | Silva et al. | 198/464.3 |
| 5,713,565 | A | 2/1998 | Meier | 270/52.16 |
| 5,823,521 | A | 10/1998 | Emigh et al. | 270/58.06 |
| 5,927,712 | A | 7/1999 | Curley et al. | 271/277 |
| 5,954,323 | A | 9/1999 | Emigh et al. | 270/58.06 |
| 6,203,084 | B1 | 3/2001 | Kruk et al. | 294/104 |
| 6,354,203 | B2 | 3/2002 | Backer et al. | 101/232 |
| 6,540,066 | B1 | 4/2003 | Von Aesch | 198/664 |
| 6,547,297 | B2 | 4/2003 | Cote et al. | 294/104 |
| 6,612,559 | B2 | 9/2003 | Boss | 270/52.18 |
| 6,616,139 | B2 | 9/2003 | Aesch | 271/204 |
| 6,655,890 | B1 | 12/2003 | Weir | 414/13 |
| 6,676,125 | B2 | 1/2004 | Thunker et al. | 271/268 |
| 6,736,061 | B2 | 5/2004 | Caunter et al. | 101/227 |
| 6,789,793 | B2 | 9/2004 | Caunter et al. | 271/175 |
| 2003/0217656 | A1 | 11/2003 | Caunter et al. | 101/228 |

FOREIGN PATENT DOCUMENTS

| | | |
|---|---|---|
| EP | 0 771 675 | 5/1997 |
| EP | 1 148 007 | 10/2001 |
| GB | 2 268 480 | 1/1994 |

*Primary Examiner* — Leslie A Nicholson, III

(74) *Attorney, Agent, or Firm* — Davidson, Davidson & Kappel, LLC

(57) ABSTRACT

A device for removing folded signatures from a saddle-back conveyor includes a moving arm, a first gripper mounted on the moving arm, and an electromechanical actuator connected to the first gripper for opening and closing the first gripper, the electromechanical actuator being mounted on the moving arm. A method is also provided.

19 Claims, 4 Drawing Sheets

SIGNATURE TRANSPORT DEVICE

CROSS-REFERENCE TO RELATED APPLICATIONS

This is a continuation of U.S. application Ser. No. 10/771,994 filed Feb. 4, 2004, which is hereby incorporated by reference herein.

BACKGROUND OF THE INVENTION

The present invention relates generally to printing presses and more particularly to a signature transport device for transporting printed products.

A web printing press, for example for newspapers, will print a continuous web of material. In a folder of the printing press, the web will be folded, if desired, and then cut, so that signatures result. The signatures can then be conveyed on a conveyor and transferred by a signature transfer device to another conveyor for further processing or delivery.

European Patent Application No. 0771 675 A1 discloses a device for removing signatures from a saddle conveyor supporting the signatures. The conveyor has cutouts that permit the signatures to be gripped from above by a rotating clamping device, which then further conveys the signatures to a belt conveyor.

U.S. Pat. No. 6,540,066 discloses a device for removing signatures from a saddle conveyor that moves the signatures over cutouts in a sword. Grippers grip the outside of the signature from above and transfer the signatures to a further conveying device.

U.S. Pat. No. 6,616,139 discloses a device for removing printed products from a sword having a rotatingly-driven gripping device with controlled gripping elements, control elements controlling the gripping elements, and a measuring device connected to the control elements to measure a thickness of the printed products. A pneumatic drive which does not rotate with the grippers adjusts a drive plate which has curve levers to adjust the control elements.

SUMMARY OF THE INVENTION

An object of the present invention is to permit efficient removal of signatures and transfer from a conveyor.

The present invention provides a device for removing folded signatures from a saddle-back conveyor comprising:

a moving arm;

a first gripper mounted on the moving arm; and an electromechanical actuator connected to the first gripper for opening and closing the first gripper, the electromechanical actuator being mounted on the moving arm.

The actuator on the arm thus can be controlled using purely electronic controls, from for example, a PLC via a low-friction electrical slip-ring assembly. Mechanical interactions with cams, levers and/or purely mechanical control elements forcing the grippers to open or close can be eliminated, and thus friction and mechanical malfunctions can be reduced. By having the electromechanical actuator move with the arm gripper timing can be changed automatically to change gripper timing even within a single rotation or reciprocation of the arm. Gripper timing can be changed automatically with a machine speed increase or decrease, and products can be transferred at all machine speed ranges. No set-up is required for product changes. Clamp force on the products can remain constant through a full range of product thicknesses to prevent damage to the product or gripper. The gripper also can be controlled to inhibit the gripper on the fly without the need for a mechanical latch-out.

Preferably the arm is a rotating arm. Within a single rotation of the arm, the gripper can be opened or closed via electronic control signals, for example as function of the rotational angle. In addition, as the signature thickness increases or decreases, the actuator can be adjusted electronically as well to adjust the gripper to the signature thickness amount.

Preferably, the first gripper is mounted rotatably on the rotating arm and remains in a horizontal orientation relative to a spine of the signatures during a full rotation of the rotating arm. Preferably, a second gripper similar to the first gripper is located on the rotating arm opposite the first gripper.

The first gripper may have a first gripper part and a second gripper part movable with respect to the first gripper part for gripping the signature. The electromechanical actuator preferably includes a pneumatic cylinder with a linkage connected to the second gripper part for moving the second gripper part.

The first gripper may be mounted on the rotating arm at a first axis, and the pneumatic cylinder preferably is fed air via an air conduit entering the pneumatic cylinder at the first axis and being rotatable with respect to the pneumatic cylinder and fixed with respect to the rotating arm. Solenoid control valves fixed to the rotating arm can feed air to each pneumatic cylinder, allowing each gripper to be controlled independently. The PLC can control the solenoid control valves via the electronic slip ring.

The gripping time and/or force for each gripper thus can be set accurately and at any time during the movement of the arm via the electronic controls.

The present invention provides a device for removing folded signatures from a saddle-back conveyor comprising:

a moving arm moving in a reciprocating or rotational movement;

a first gripper mounted on the moving arm;

an electromechanical actuator connected to the first gripper for opening and closing the first gripper, the electromechanical actuator being mounted on the moving arm; and a controller for providing electronic signals so as to direct the electromechanical actuator to open or close the first gripper during the reciprocating or rotational movement.

The present invention also provides a method for removing signatures from a saddle-back conveyor comprising the steps of:

reciprocating or rotating an arm to move a gripper to remove signatures from a saddle-back conveyor, the arm defining a range of motion; and providing electronic controls to open and close the gripper to grip the signature during the range of motion.

As opposed to cam-operated opening and closing methods, the present invention uses electronic controls to open and close the gripper on the signature, which can reduce friction and provide more accurate gripper control.

The method may further include adjusting a closing distance as a function of the signature thickness.

A saddle-back conveyor as defined herein includes any conveyor on which the signature conveyed straddling a chain or belt.

BRIEF DESCRIPTION OF THE DRAWINGS

The following figures show a preferred embodiment of the present invention in which.

DETAILED DESCRIPTION OF A PREFERRED EMBODIMENT

Figure 1:
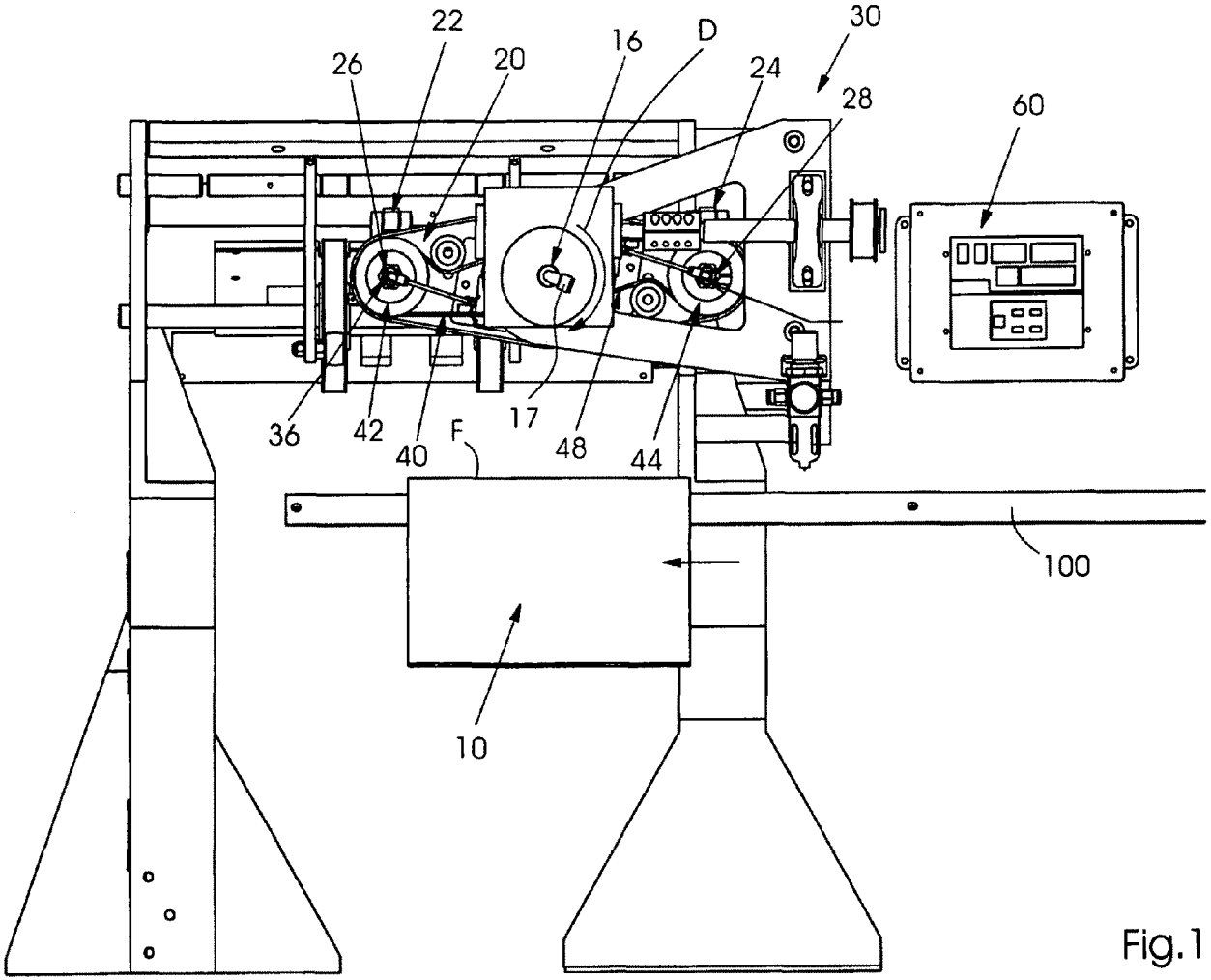
FIG. 1 shows a side view of an embodiment according to the invention of a device for removing a folded signature from a conveying device.

FIG. 1 shows a preferred exemplary embodiment of a signature transport device of the present invention. Signatures 10 are created and conveyed on a conveyor 100 as for example in the manner described U.S. Patent Publication No. 2003-0217656, which is hereby incorporated by reference herein.

The signatures may be lifted from the conveyor by a signature lifting device passing between, for example, two chains of the conveyor and lifting the signature from below at the fold. Alternately, the signatures may be lifted directly from conveyor 100 or from a sword.

Signature transport device 30 can then lift the signatures using grippers 22, 24 rotatingly mounted on a rotating arm 20 driven by a drive shaft 16, which rotates in a direction D. Grippers 22 and 24 rotate with respect to arm 20 so as to maintain a similar orientation, i.e. so that the gripper edge remains parallel to a fold F of signature 10 or a direction of movement of conveyor 100. Thus as signature 10 is lifted, one of the grippers 22, 24 grips the fold F from the outside and transports the signature upwardly.

Figure 2B:
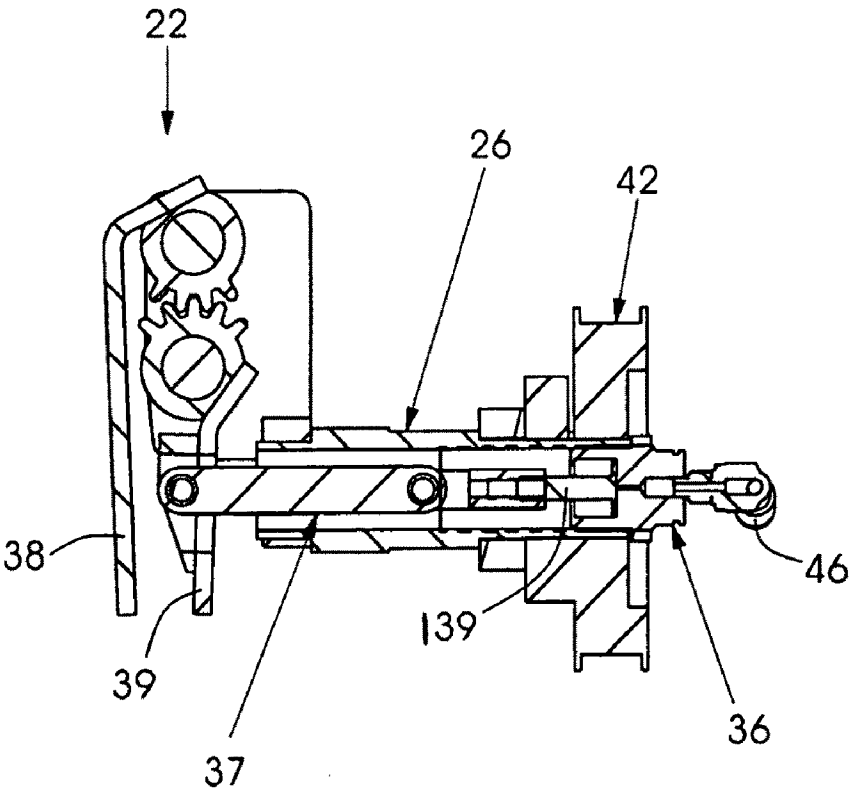
FIG. 2A shows a detailed view of the one of the grippers of the FIG. 1 device and FIG. 2B shows a sectional view through the line A-A of FIG. 2A.
Figure 2A:
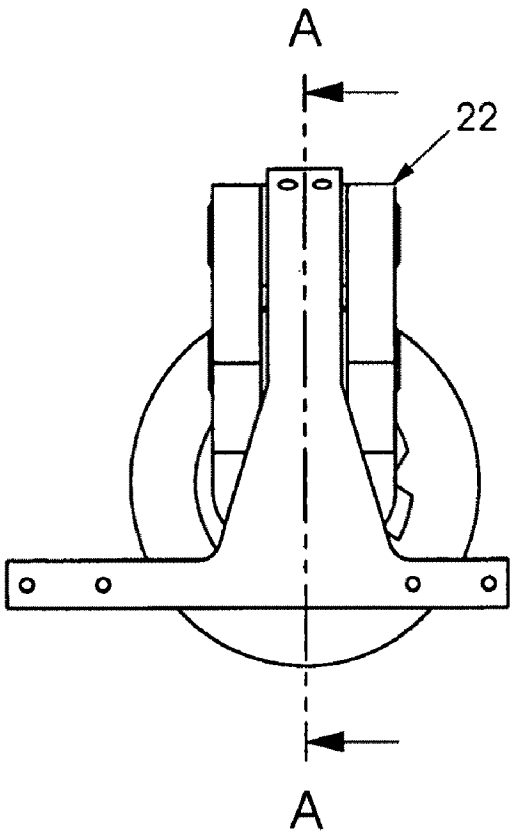
Figure 3B:
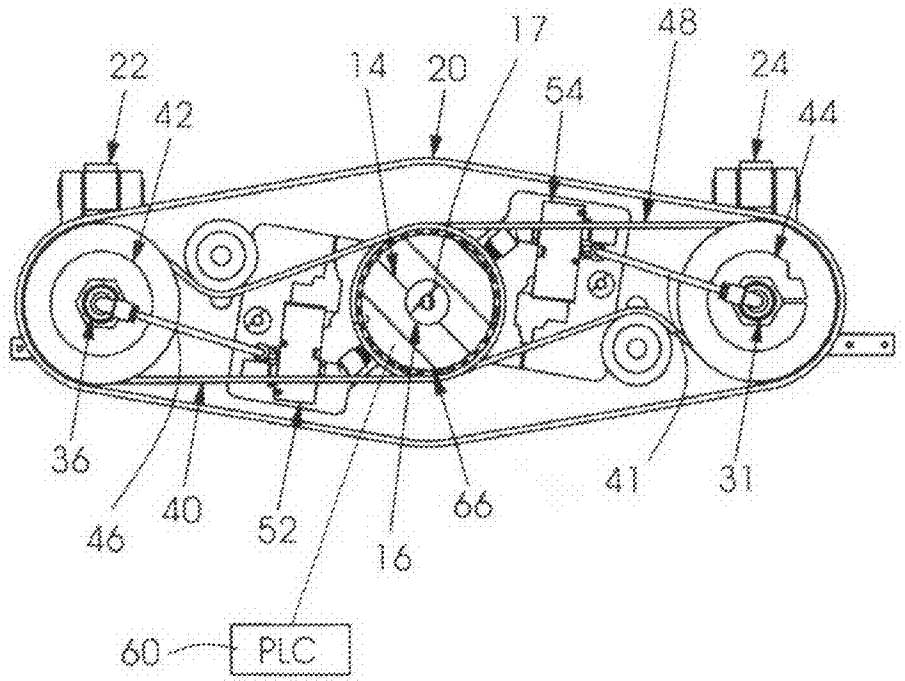
FIG. 3A shows a partial end view of the FIG. 1 device and FIG. 3B shows a sectional view through the line B-B of FIG. 3A.

The grippers 22, 24 are rotatable in the arm via gripper housing shafts 26, 28, respectively. In the center of each housing shaft 26, 28 is a pneumatic cylinder 36, 31, as shown in FIG. 3B, controlling a linkage 37 via a plunger 139, shown in FIG. 2B, to gripper 22. Air is supplied to the cylinders 36, 31 via pneumatic lines 46, 41, respectively. As shown in FIGS. 2A and 2B, gripper 22 for example may include a first gripper part 38 and a second gripper part 39 geared together, and linkage 37 can move so as to close or open first and second gripper parts 38, 39. Pneumatic line 46 may rotate with respect to cylinder 36, for example via a seal bearing.

Cylinder 36 may, for example, be spring-loaded to open against the pressure of air being provided via line 46 so as to accurately set the axial position of plunger 139, and thus the gripper opening distance.

A belt 40 runs over a pulley 42 and a stationary pulley 66 (FIG. 3B), and another belt 48 runs over a pulley 44 and stationary pulley 66. Pulleys 42, 44 are fixed to rotate with their respective grippers 22, 24, so that as arm 20 rotates, the belts 40, 48 cause grippers 22, 24 to maintain their horizontal orientation with respect to the spine of the signature 10 through a full rotation of arm 20.

Figure 3A:
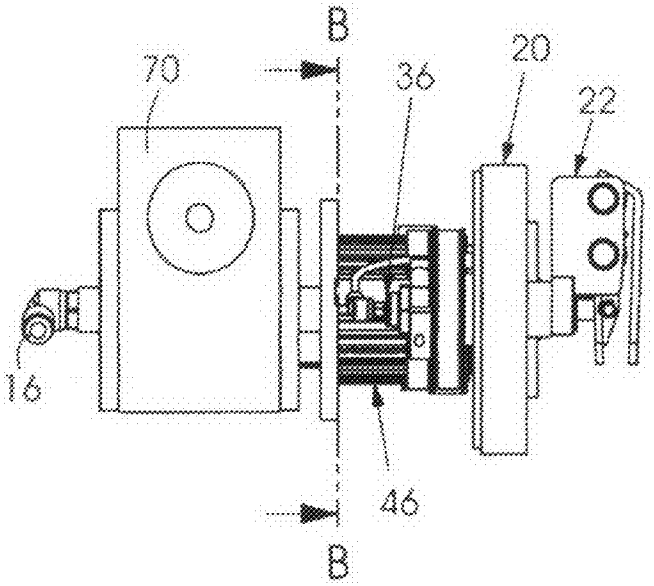

As shown in FIG. 3B, air is fed to the pneumatic cylinders 36, 31 so as to control each gripper 22, 24 independently. Air is supplied to the lines 46, 41 via solenoid control valves 52, 54 by a main air supply 17 at the center of a main shaft 16 for the arm 20. Main air supply 17 may for example be rotatable with respect to main shaft 16 via a seal bearing. As shown in FIG. 3A, main shaft 16 may be driven by a drive motor 70.

The amount of air supplied via the solenoid control valves 52, 54 thus can set the opening or closing position. The solenoid control valves 52, 54 in turn are controlled electronically via controls from a controller 60, which for example is a control processing unit or programmable logic controller. As shown in FIG. 3B, the controller 60 is connected electronically to the solenoid control valves 52, 54 via slip ring 14, and may provide digital control signals for example through PCM (pulse code modulation), PAM, PDM or PPM signals. The control signals may have a header for indicating whether the body of the control signal is for valve 52 or 54, and thus each valve 52, 54 may be controlled independently.

Figure 4:
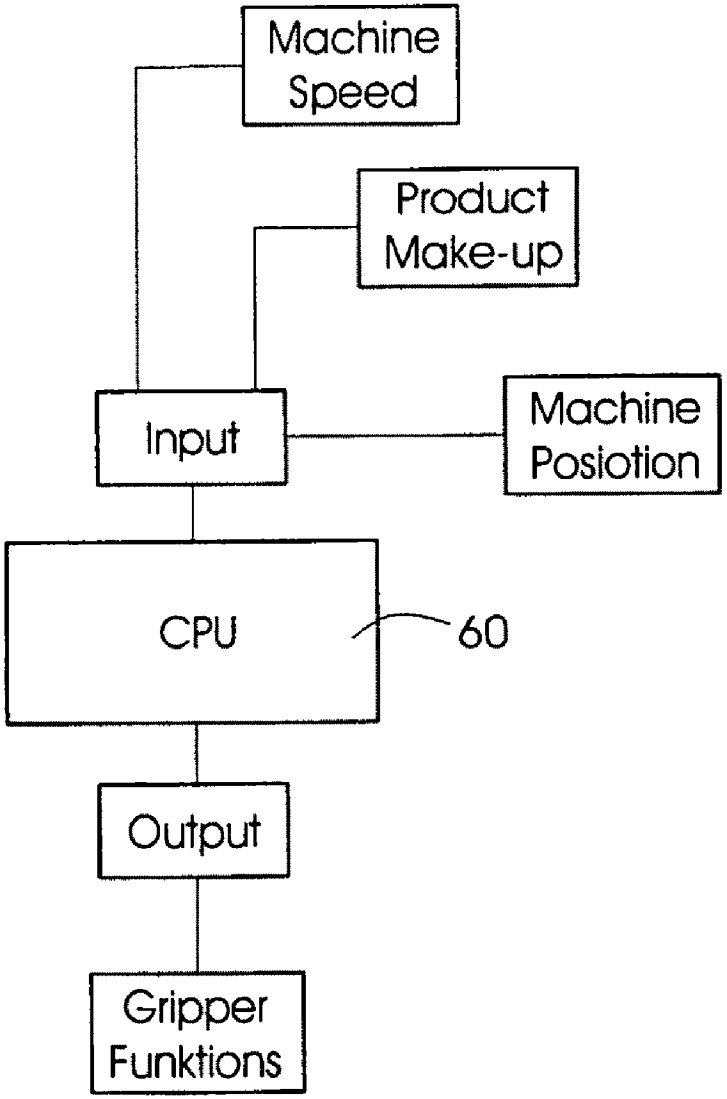
FIG. 4 shows a schematic view of the connections to the main processing unit shown in FIG. 1.

As shown schematically in FIG. 4, the machine speed and position, for example the arm speed and position, known via another controller or sensors for example, can be provided as inputs to the controller 60. The product makeup, including for example the product thickness, known via another controller or via a sensor, can provide another input. The controller 60 then can control the gripper opening and closing motion (i.e. the distance each gripper is opened) through the entire range of motion of the gripper arm. For example, if the product thickness is 1 cm, the gripper can be set to be open 2 cm at the 90 degree position in FIG. 1 (top) and then be set to close to 0.95 cm or more at the 180 degree position, thus gripping the signature 10 with a desired gripping force. The closing curve for each gripper between the 90 and 180 degree position, and over the whole range of motion, can be set electronically via the controller 60. Thus a release point of the signature from the gripper to another conveyor can also be set, for example at the zero position.

The closing distance of the gripper for gripping the printed product may be a function of the type of material of signature 10 as well as the thickness.

Other electromechanical actuators may include actuators such as direct solenoid driven cylinders or hydraulic actuators.

"Signature" as defined herein can include single sheet or multi-sheet printed product. "Arm" as defined herein is any rotating support structure.

What is claimed is:

1. A device for moving folded signatures with respect to a saddle-back conveyor comprising:

a rotating arm rotating a full rotation about an axis;

a first gripper mounted on the moving arm; and an electromechanical actuator connected to the first gripper for opening and closing the first gripper, the electromechanical actuator being mounted on the moving arm and rotating a full rotation about the axis; and a control device for actuating the electromechanical actuator, the control device being mounted on the rotating arm and rotating a full rotation about the axis.

2. The device as recited in claim 1 further comprising a controller sending electronic signals via the control device to the electromechanical actuator for opening and closing the first gripper.

3. The device as recited in claim 1 wherein the first gripper is mounted rotatably on the rotating arm and remains in a horizontal orientation relative to a spine of the signatures during a full rotation of the rotating arm.

4. The device as recited in claim 1 further comprising a second gripper located on the rotating arm opposite the first gripper.

5. The device recited in claim 1 wherein the control device is an electronic control valve.

6. A device for moving folded signatures with respect to a saddle-back conveyor comprising:

a rotating arm rotating a full rotation about a first axis;

a first gripper mounted on the moving arm;

an electromechanical actuator connected to the first gripper for opening and closing the first gripper, the electromechanical actuator being mounted on the moving arm and rotating a full rotation about the first axis; and the first gripper having a first gripper part and a second gripper part movable with respect to the first gripper part for gripping the signature, the electromechanical actuator including a pneumatic cylinder with a linkage connected to the second gripper part for moving the second gripper part, the first gripper being mounted on the arm at a second axis, the pneumatic cylinder being fed air via an air conduit entering the pneumatic cylinder at the second axis.

7. The device as recited in claim 6 further comprising an electronic control valve mounted on the rotating arm for providing air to the pneumatic cylinder, the electronic control valve rotating a full rotation about the first axis.

8. The device as recited in claim 7 wherein the electronic control valve is a solenoid control valve.

9. A device for moving and transferring folded signatures with respect to a saddle-back conveyor comprising:

a rotating arm rotating a full rotation about an axis;

a first gripper mounted on the rotating arm;

a second gripper mounted on the rotating arm;

a first electromechanical actuator connected to the first gripper for opening and closing the first gripper, the first electromechanical actuator being mounted on the moving arm and rotating a full rotation about the axis, the first electromechanical actuator including a first pneumatic cylinder; a second electromechanical actuator connected to the second gripper for opening and closing the second gripper, the second electromechanical actuator being mounted on the moving arm and rotating a full rotation about the axis, the second electromechanical actuator including a second pneumatic cylinder;

a stationary control signal input, the first and second electromechanical actuators moving with respect to the control signal input during rotation about the axis;

at least one control device for actuating the first electromechanical actuator and the second electromechanical actuator; and a controller sending electronic signals via the stationary control signal input to the at least one control device instructing the first and second electromechanical actuators for opening and closing the first and second grippers respectively.

10. The device as recited in claim 9 wherein the first gripper is mounted rotatably on the rotating arm and remains in a horizontal orientation relative to a spine of the signatures during a full rotation of the rotating arm.

11. The device as recited in claim 9 wherein the first gripper is mounted on the arm at a first axis, and the first pneumatic cylinder is fed air via an air conduit entering the pneumatic cylinder at the first axis.

12. A signature transport device comprising:

a saddle-back conveyor; and the device according to claim 9.

13. The device recited in claim 9 wherein the at least one control device includes a first control device for actuating the first electromechanical actuator and a second control device for actuating the second electromechanical actuator, the first and second control devices being mounted on the rotating arm and rotating a full rotation about the axis.

14. The device as recited in claim 13 wherein at least one of the first and second electromechanical actuators is in a slip contact via at least one of the first and second control devices with the stationary control signal input.

15. The device recited in claim 13 wherein the first control device and the second control device are electronic control valves.

16. The device as recited in claim 13 wherein at least one of the first and second control devices is an electronic control valve for providing air to the first or second pneumatic cylinder, respectively.

17. The device as recited in claim 16 wherein the electronic control valve is a solenoid control valve.

18. The device as recited in claim 9 wherein the controller is capable of setting a position of the first or second gripper over a full range of the rotational movement.

19. The device as recited in claim 18 wherein the controller adjusts a closing distance of the first gripper as a function of the signature thickness or material.

* * * * *